US005709496A

United States Patent [19]

Werner et al.

[11] Patent Number: 5,709,496

[45] Date of Patent: Jan. 20, 1998

[54] APPARATUS FOR STORING FILM CARTRIDGE AND PROOFS

[75] Inventors: Richard S. Werner, 326 Cedar Sauk Rd., West Bend, Wis. 53095; Carey P. Woods, Plum City, Wis.

[73] Assignee: Richard S. Werner, West Bend, Wis.

[21] Appl. No.: 714,353

[22] Filed: Sep. 16, 1996

[51] Int. Cl.[6] ..... B42F 13/00

[52] U.S. Cl. ..... 402/79; 402/4; 281/38; 206/455

[58] Field of Search ..... 402/79, 4, 80 R; 206/455, 456; 281/38, 51

[56] References Cited

U.S. PATENT DOCUMENTS

| | | | |
|---|---|---|---|
| 4,907,904 | 3/1990 | Baldwin | 402/79 X |
| 5,000,319 | 3/1991 | Mermelstein | 402/79 |
| 5,040,216 | 8/1991 | Policht | 402/79 |
| 5,301,803 | 4/1994 | Hansen et al. | 206/455 X |
| 5,303,825 | 4/1994 | Hansen et al. | 206/455 X |
| 5,374,975 | 12/1994 | Amat | 206/455 X |
| 5,431,449 | 7/1995 | Arimoto et al. | 402/79 |
| 5,459,549 | 10/1995 | Barr | 206/455 X |
| 5,480,192 | 1/1996 | Angerbauer et al. | 402/79 X |
| 5,546,155 | 8/1996 | Yamamoto | 206/455 |

*Primary Examiner*—Willmon Fridie, Jr.

*Attorney, Agent, or Firm*—Jansson, Shupe, Bridge & Munger, Ltd.

[57] ABSTRACT

An apparatus for storing and protecting in a coordinated manner developed film and printed photographs, particularly those associated with the Advanced Photo System ("APS"). Such apparatus is comprised of a sheet-like article configured for binding at one end having an opposing free edge, a first and second surface, and opposing first and second free edges perpendicular to the binding edge. A transverse crease extends along the article defining a flap that is used to secure the film container. A print storage device and film container are attached to the article in such a manner as to allow the flap to fold back over the container thereby securing the it by allowing the container to fit through a hole in the flap while the flap adheres to the sheet-like article.

11 Claims, 4 Drawing Sheets

APPARATUS FOR STORING FILM CARTRIDGE AND PROOFS

FIELD OF THE INVENTION

This invention relates to storing and protection of developed film and printed photographs, and more specifically, to storing and protecting such film and photographs associated with what has come to be known as the Advanced Photo System.

BACKGROUND OF THE INVENTION

Several devices exist for the storage of photographs and developed photographic film. These devices include photo albums having loose-leaf transparent film storing sheets configured with a number of photo-sized pockets. Strips of developed film, commonly called "negatives," are stored in similar, appropriately-sized pockets configured in similar sheets. These sheets are usually bound together by the use of some mechanical retainer such as a three-ring binder.

Another storage device is of the type disclosed in U.S. Pat. No. 5,040,216 (Policht). This device involves taping the edge of a photograph to a binder member having a double-adhesive-coated strip attached to it. The binder members are then bound together by the use of retainers located at the opposite end of the album's spine. Strips of negatives are stored in a pocket located in one of the album's covers. A major drawback of this device is that it has no place for storing a film cartridge.

U.S. Pat. No. 5,431,449 (Arimoto et al.) discloses a device involving a film sheet that provides for the storage of an index print on which recorded images on a developed film are printed. The Arimoto et al. patent also uses a film sheet having a plurality of small pockets to store the developed film.

As with other patents involving photo albums, the major drawback associated with the product of the Arimoto patent is that it does not allow for the combined storage of a film cartridge and associated prints. Such limitation is a major problem when dealing with photographs taken using the Advanced Photo System ("APS").

APS is a new process related to the field of photography. With the APS, information regarding the film speed, emulsion details and photograph length are magnetically recorded on the film. When a photograph is being taken, the camera reads the information on the film and can then automatically add exposure information in order to correct for lighting errors. These corrections result in better photo-finishing.

Using the APS, a photographer may preselect the size of the finished photographic print prior to taking a picture. This feature allows an individual to take pictures of various sizes using the same role of film.

Because print information is digitized on to the film, the developed film will remain in the original film canister. As a result, the consumer will no longer be receiving the familiar negatives. They are provided, however, with an index card—much like a proof sheet—along with their printed photographs. The index card shows "mini-versions" of all of the pictures on a particular roll of film.

Because the developed film is returned to the consumer in its original canister, a device is needed that will allow the consumer to store the proof sheet along with the film canister. Such a device is necessary because the proof sheet is the only way one has of determining what exposures are contained in a film canister.

A binder compatible with the APS is made by HAMA of Bayern, Germany. Such binder resembles a 3-ring notebook and when the binder is opened, a left-side surface has what are called cartridge safes for storing several APS film cartridges. The right-side surface has a number of overlapping insert pockets for storing what are known as index prints. Another version has a left-side surface with a single cartridge safe and a number of insert pockets for storing index prints. The right-side surface (apparently) has only insert pockets.

An apparent disadvantage of the HAMA arrangement is that, to the user, the relationship of a particular cartridge with a particular index print is not readily apparent or at least seemingly so. Although the HAMA arrangement permits storing several cartridges and index prints, the user (upon opening the binder) is presented with a perhaps-bewildering array of cartridges and index prints from which to select. And the HAMA arrangement does not contemplate a single "wallet-like" apparatus for storing a single cartridge and index print.

A device that allows one to more easily coordinate the storage of the APS proof sheets along with the film canisters and to address and overcome other disadvantages of the prior art would be an important improvement in the art.

OBJECTS OF THE INVENTION

An object of the invention is to provide a photo/photo-cartridge delivery/storage packet that overcomes some of the problems and shortcomings of the prior art.

Another object of the invention is to provide a photo/photo-cartridge delivery/storage packet that allows for the storage of the photographic proof-sheet and its corresponding film cartridge separate from the photographs themselves.

Still another object of the invention is to provide a photo/photo-cartridge delivery/storage packet that allows for the organized storage of the photographic proof-sheet and its corresponding film cartridge.

Yet another object of the invention is to provide a photo/photo-cartridge delivery/storage packet that allows for the secure storage of the film canister.

SUMMARY OF THE INVENTION

The invention involves an apparatus for storing photographic prints and image film. Such apparatus is comprised of a sheet-like cover or article that is configured to be bound on one edge and has an opposing free edge, a first and second surface, and opposing first and second free edges which are perpendicular to the bound edge. Attached to the sheet-like article is a print storage device and a film container. The film container is attached to the article along a first axis coincident with the print storage device.

A transverse crease extends along the article and a flap extends to the transverse crease and is mounted for movement toward and away from the container. The flap has an adhesive on it and is configured to trap the container between the flap and the article when the flap contacts the article.

In a preferred embodiment of the invention, the adhesive that is applied to the flap is a double-sided tape where the more "aggressive" or more-adherent side of the double-sided tape (referred to in this specification as the "higher adhesive side") is attached to the flap so that the less-adherent lower adhesive side contacts the surface of the sheet-like article. Such selection and use of adhesive allows the flap to be repeatedly open and closed while yet retaining the tape on the flap.

In a highly preferred embodiment, the flap has a free edge and there is a hole in the flap between the transverse crease and the flap outward or free edge. The hole in the flap and the container are cooperatively sized and shaped and the container fits through the hole in the flap when the flap is folded over such container. In yet another aspect of the invention, the container is a blister pack (a domed container having laterally-extending flat edges) positioned in the hole. The blister pack confines a cartridge having the image film therein.

Yet another feature of the invention involves a slit extending from the transverse crease toward the free edge of the flap. Most preferably, there are two or more parallel, spaced-apart slits extend from the transverse crease toward the free edge of the flap.

And the print storage device may take one of several different forms. For example, one specific print storage device is an envelope-like pouch and the photographic print slides in and out of the pouch. Another type of print storage device is a bracket which "grasps" edges of a print for print retention. Still another type of print storage device is a plurality of slots cut into the sheet-like article. Corners of the print are inserted into respective slots.

Other details of the new apparatus are set forth in the following detailed description and in the drawings.

DETAILED DESCRIPTIONS OF THE PREFERRED EMBODIMENTS

Figure 1:
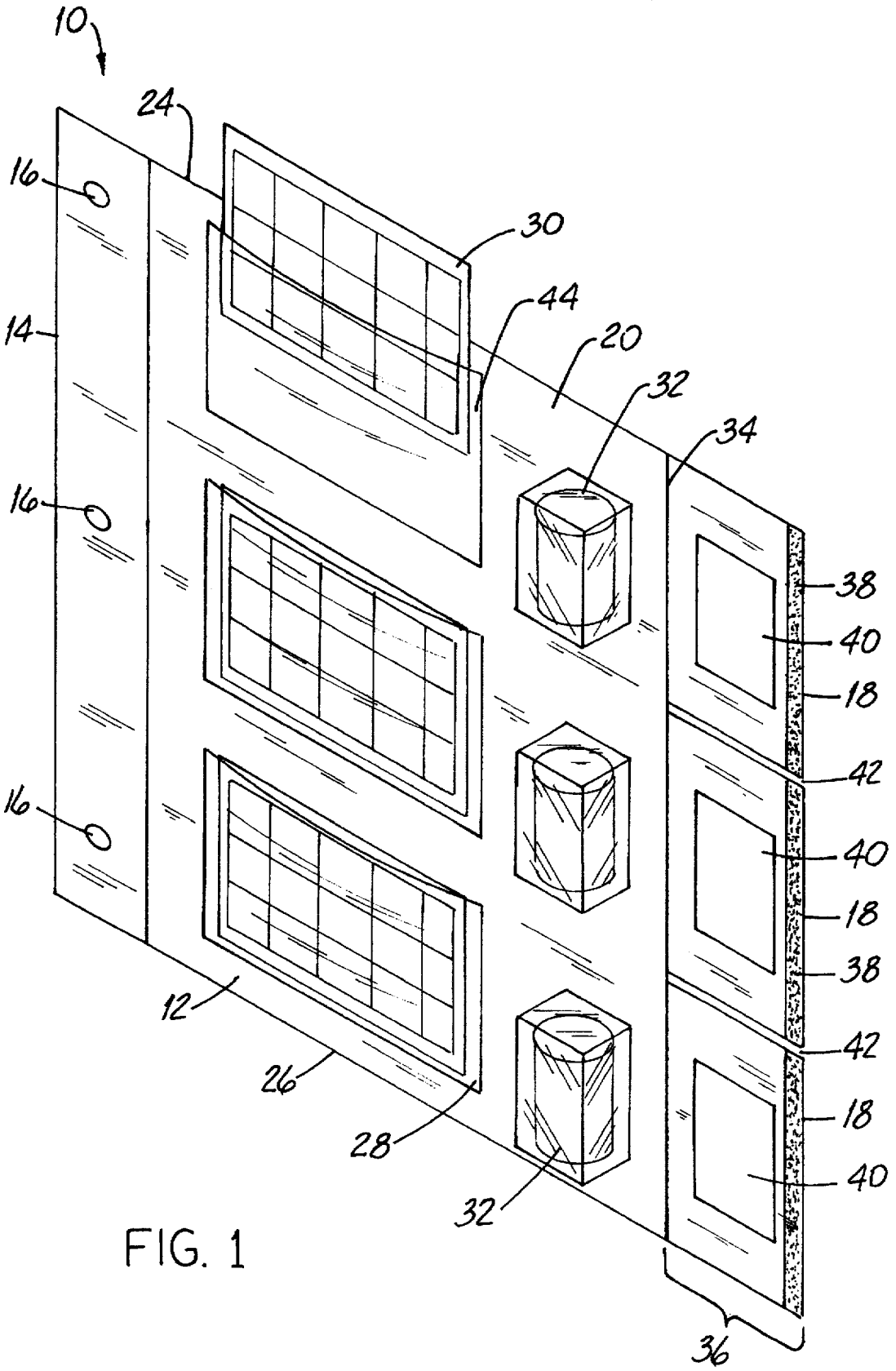
FIG. 1 is a perspective view of the proof and film cartridge storage apparatus showing the film cartridge containers and securing flaps positioned opposite the binding edge and a clear storage pouch being employed as the proof sheet storage device.

FIG. 1 shows an embodiment of an apparatus 10 for storing photographic prints and image film. Such apparatus 10 is comprised of a sheet-like cover or article 12 that is configured to be bound on one edge 14. In a specific embodiment, the article has openings 16 punched along such edge 14 for retention in a three-ring binder or the like. In the alternative, the bound edge 14 may have one or more brackets or may use adhesive to retain the article in a binder.

The article also has an opposing free edge 18, first and second surfaces 20 and 22, respectively, and opposing first and second free edges 24 and 26, respectively, which are perpendicular to the bound edge 14. Attached to the first surface 20 of the sheet-like article 12 is a print storage device 28 for holding an image sheet 30 or what has come to be known as an index print in the Advanced Photo System. (The index print is so named because the location and sequence of the very-small images upon it provide an "index" of the images upon the film in a film container).

A film container 32 is also attached to the article 12. The film container 32 is coincident with a first axis that is also coincident with the print storage device 28. In the illustrated embodiment, the first axis is horizontal when its binder is upright on an edge for storage and when the binder and article are flat and open during use. It is to be appreciated that axial alignment of each storage device 10 and the container associated therewith makes "matching" of a film and an index print very quick and easy.

A transverse crease 34 extends along the article 12 and a flap 36 extends to the transverse crease 34 and is mounted for movement toward and away from the container 32. The flap 36 has an adhesive 38 on it and is configured to trap the container 32 between the flap 36 and the article 12 when the flap 36 is folded over and contacts the article 12.

Figure 2:
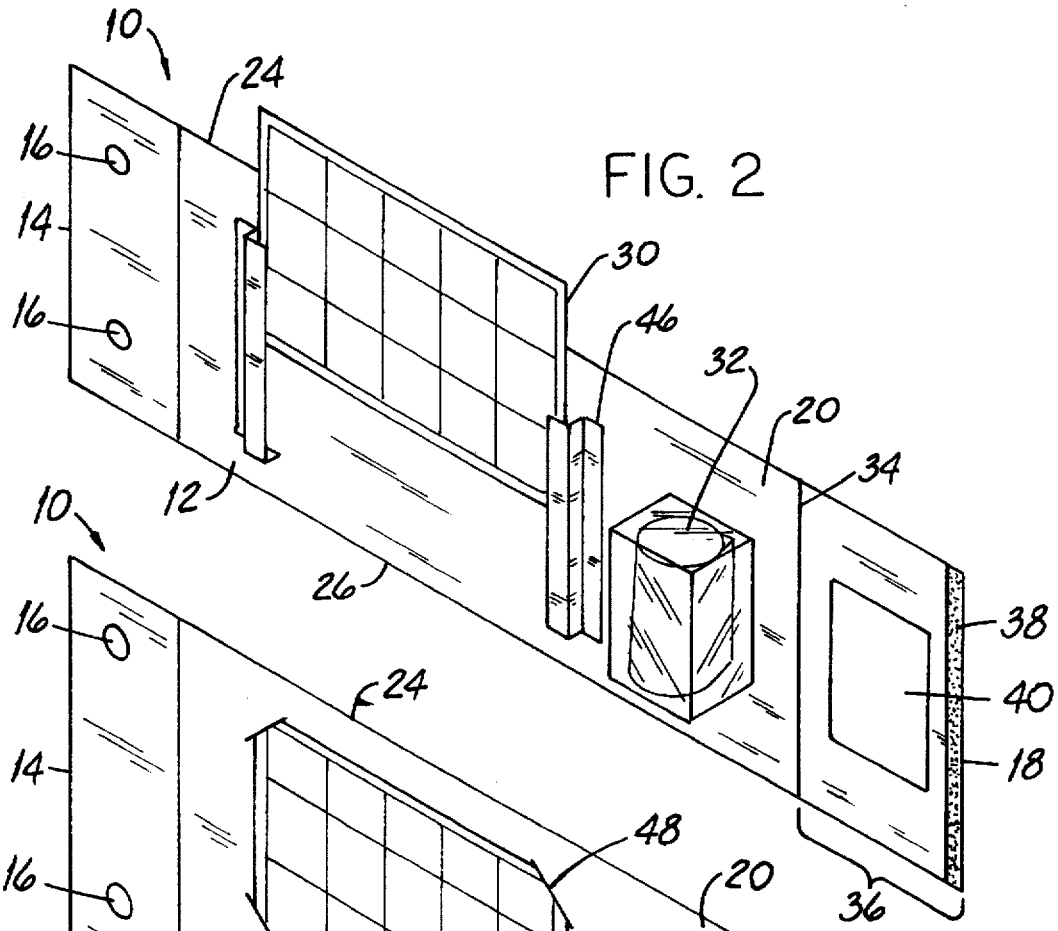
FIG. 2 is a perspective view of the proof and film cartridge storage apparatus showing a bracket being employed as the proof sheet storage device.
Figure 3:
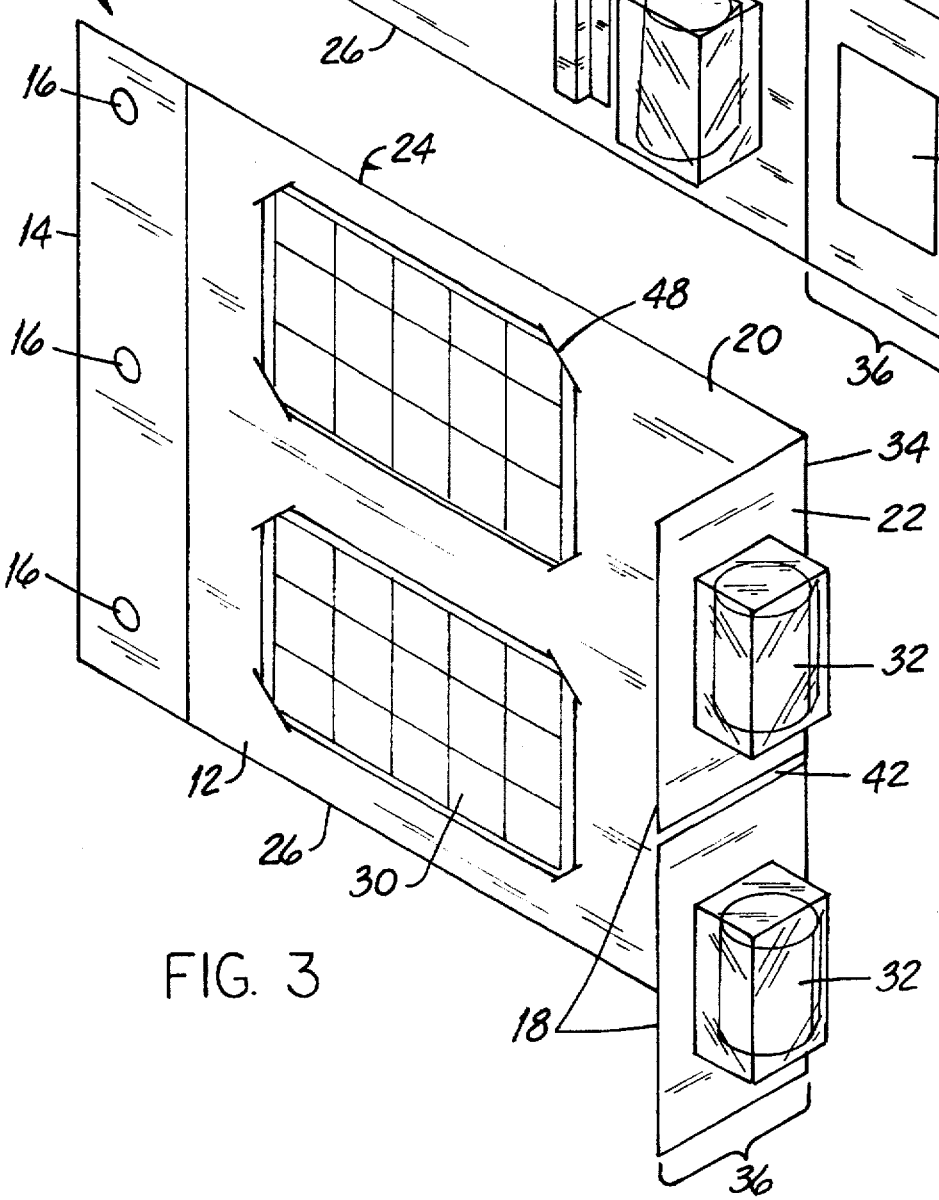
FIG. 3 is a perspective view of the proof and film cartridge storage apparatus showing the film cartridge containers secured in the securing flaps and slits cut into the sheet-like article being employed as the proof sheet storage device.
Figure 4:
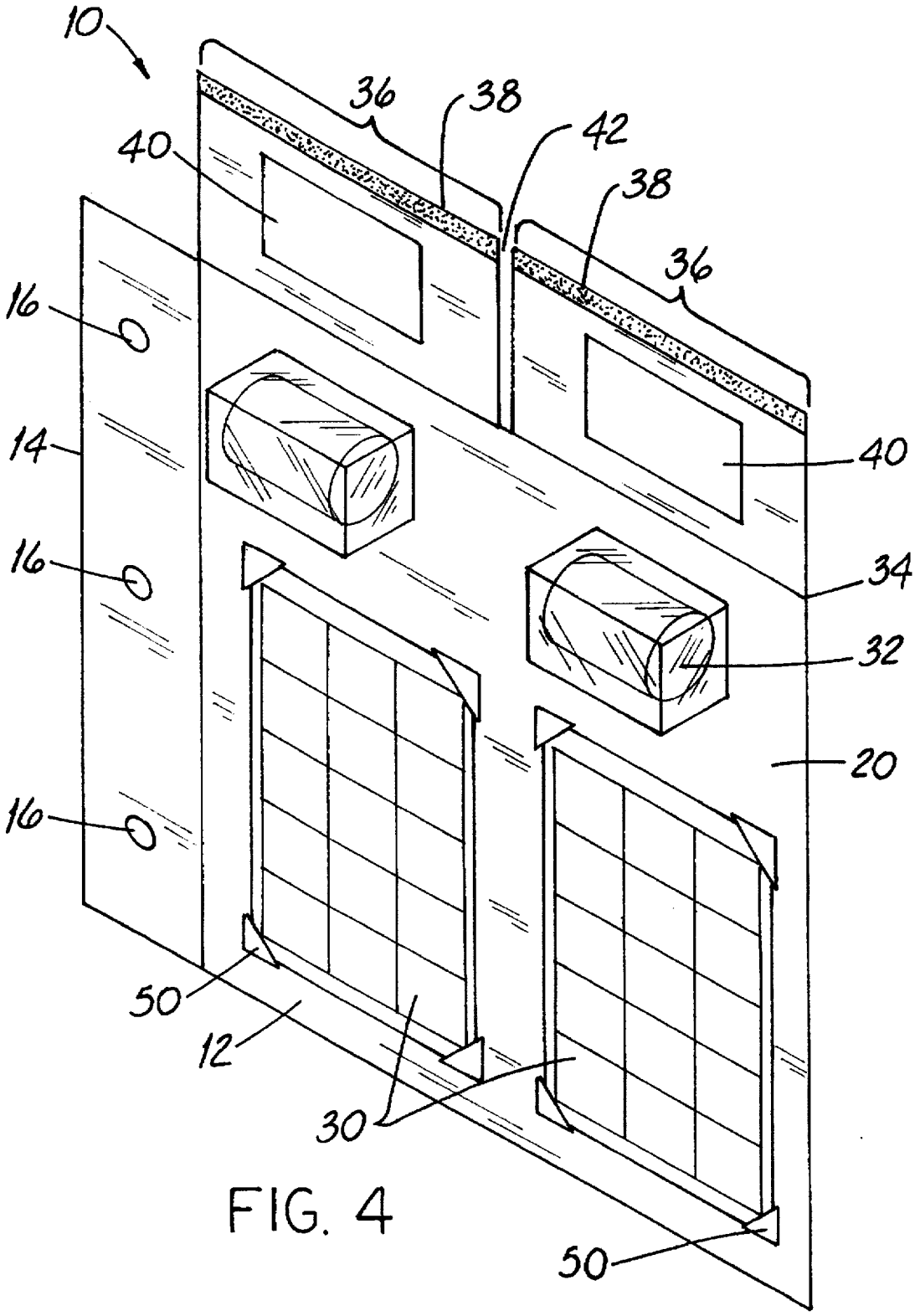
FIG. 4 is a perspective view of the proof and film cartridge storage apparatus showing the securing flaps and film storage cartridges positioned along the top portion of the apparatus.
Figure 5:
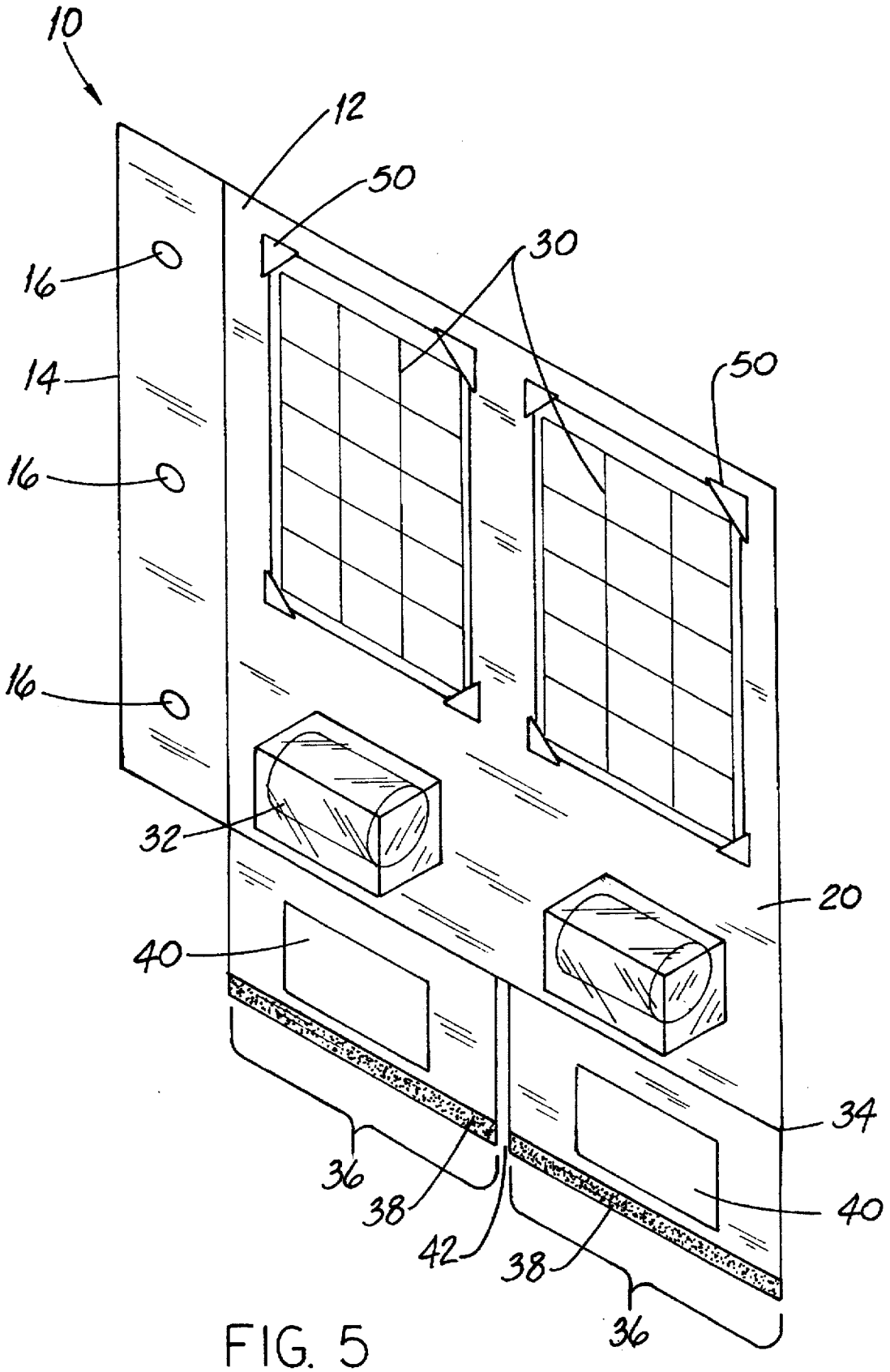
FIG. 5 is a perspective view of the proof and film cartridge storage apparatus showing the securing flaps and film storage cartridges positioned along the bottom portion of the apparatus.

In the embodiment shown in FIGS. 1, 2, and 3, the transverse crease 34 and flap 36 are situated opposite the bound edge 14. However, other embodiments (e.g., those shown in FIGS. 4 and 5) allow for the crease 34 and flap 36 to be located at either the top or bottom of the article 12. Likewise in the preferred embodiment, as shown in FIGS. 1–3, the axis aligning the print storage device 28 and film container 32 is perpendicular to the binding edge 14 while in other embodiments, as shown in FIGS. 4 and 5, such axis is parallel to the bound edge 14.

In a preferred embodiment of the invention, the adhesive 38 that is applied to the flap 36 is a double-sided tape, the higher adhesive side of which is attached to the flap 36. When the flap 36 and tape are so arranged, the lower adhesive side of the tape contacts the surface 20 of the sheet-like article 12. Such selection and use of adhesive allows the flap 36 to be repeatedly open and closed while yet retaining the tape on the flap 36.

In a highly preferred embodiment, as shown in FIG. 1, there is a hole 40 in the flap 36 between the transverse crease 34 and the free edge 18. (It is to be appreciated that in this specific embodiment, the article 12 and the flap 36 have the same free edge 18.) The hole 40 in the flap 36 and the container 32 are cooperatively sized and shaped and the container 32 fits through the hole 40 in the flap 36 when the flap 36 is folded over such container 32. FIG. 3 shows yet another aspect of the invention where the container 32 is a blister pack (a domed container having laterally-extending flat edges) positioned in the hole. The blister pack confines a cartridge 32 having the image film therein.

Referring next to FIGS. 1 and 3, yet another feature of the invention involves a slit 42 extending from the transverse crease 34 toward the free edge 18 of the flap 36. Most preferably, there are two or more parallel, spaced-apart slits 42 extending from the transverse crease 34 toward the free edge 18 of the flap 36. In an article configured to hold two or more index prints 30 and related films, this configuration is advantageous as it permits one to withdraw and replace a single film cartridge 32 without the risk of exposing other cartridges 32 to loss.

And the print storage 28 device may take one of several different forms. For example, one specific print storage device 28 is an envelope-like pouch 44 and the photographic print 30 slides in and out of the pouch 44 as shown in FIG. 1. Another type of print storage device 28, shown in FIG. 2, is a bracket 46 which "grasps" edges of a print for print retention. Still another type of print storage device 28 is a plurality of slots 48 cut into the sheet-like article 12 as shown in FIG. 3. Corners of the print 30 are inserted into respective slots 40. Yet another type of print storage device 28 as shown in FIGS. 4 and 5 involves the use of corner holders 50 secured to the article 12.

From the foregoing, it is to be appreciated that the film container 32 may be attached only to the first surface 20 of the article, may be attached only to the flap 36 or may be attached merely by being trapped between the first surface 20 and the flap 36. When used in reference to the film container 32, the phrase "attached to the article" means any of the foregoing.

While the principles of the invention have been shown and described in connection with but a few embodiments, it is to be understood clearly that such embodiments are by way of example and are not limiting.

What is claimed:

1. An apparatus for storing photographic prints and image film, such apparatus comprising a sheet-like article configured to be bound on one edge, having an opposing free edge, first and second surfaces, and opposing first and second free edges perpendicular to the bound edge and wherein;

a print storage device is attached to the article;

a film container is attached to the article along a first axis coincident with the print storage device;

a transverse crease extends along the article;

a flap, having a hole, extends to and terminates at the transverse crease and is mounted to fold along the transverse crease toward and away from the container; and the flap has an adhesive thereon, thereby configuring the apparatus to trap the container when the flap contacts the article.

2. The apparatus of claim 1 wherein the adhesive applied to the flap is a double-sided tape;

the double-sided tape has first and second sides;

the first side is coated with a first adhesive;

the second side is coated with a second adhesive, said second adhesive being of lower bond than the first adhesive; and the first side of the double-sided tape is attached to the flap.

3. The apparatus of claim 2 wherein the flap has a free edge and the hole in the flap is located between the transverse crease and the free edge of the flap.

4. The apparatus of claim 3 wherein the container fits through the hole in the flap when the flap is folded over such container.

5. The apparatus of claim 3 wherein the container is a blister pack which fits through the hole in the flap when the flap is folded over such blister pack.

6. The apparatus of claim 5 wherein the blister pack confines a cartridge having the image film therein.

7. The apparatus of claim 3 including a slit extending from the transverse crease toward the free edge of the flap.

8. The apparatus of claim 3 including a plurality of slits extending from the transverse crease toward the free edge of the flap.

9. The apparatus of claim 1 wherein the print storage device is a pouch.

10. The apparatus of claim 1 wherein the print storage device is a bracket.

11. The apparatus of claim 1 wherein the print storage device is a plurality of slots cut into the sheet-like article.

* * * * *